US007903075B2

(12) United States Patent
Akimoto

(10) Patent No.: US 7,903,075 B2
(45) Date of Patent: Mar. 8, 2011

(54) IMAGE DISPLAY APPARATUS

(75) Inventor: Hajime Akimoto, Kokubunji (JP)

(73) Assignee: Hitachi Displays, Ltd., Chiba-ken (JP)

( * ) Notice: Subject to any disclaimer, the term of this patent is extended or adjusted under 35 U.S.C. 154(b) by 911 days.

(21) Appl. No.: 11/328,306

(22) Filed: Jan. 10, 2006

(65) Prior Publication Data

US 2006/0181539 A1 Aug. 17, 2006

(30) Foreign Application Priority Data

Feb. 17, 2005 (JP) ..... 2005-040016

(51) Int. Cl.
*G09G 3/36* (2006.01)

(52) U.S. Cl. ..... 345/100; 345/98

(58) Field of Classification Search ..... 257/E27.085; 345/204, 87–100
See application file for complete search history.

(56) References Cited

U.S. PATENT DOCUMENTS 4,959,698 A * 9/1990 Shinichi ..... 257/296
5,936,874 A * 8/1999 Clampitt et al. ..... 365/51
7,233,537 B2 * 6/2007 Tanizaki et al. ..... 365/209
7,446,776 B2 * 11/2008 Clewett et al. ..... 345/530
7,515,123 B2 * 4/2009 Shirasaki ..... 345/76
2002/0147102 A1 * 10/2002 Yamazaki et al. ..... 501/70
2003/0016190 A1 * 1/2003 Kondo ..... 345/55
2003/0142540 A1 * 7/2003 Tanizaki et al. ..... 365/171

FOREIGN PATENT DOCUMENTS

JP 11-085065 9/1997
JP 2002-082656 9/2000
JP 2003-005709 6/2001
JP 2003-122301 10/2001

* cited by examiner

*Primary Examiner* — Amare Mengistu
*Assistant Examiner* — Viet Pham
(74) *Attorney, Agent, or Firm* — Stites & Harbison PLLC; Juan Carlos A. Marquez, Esq.

(57) ABSTRACT

An image display apparatus with a portion of a display substrate area, around a display section, being small, low in power consumption, and capable of effecting high-definition image display. A built-in memory configuration is provided wherein one unit of analogue image signal is generated on the basis of a memory cell signal selected by not less than two lengths of select metal interconnects form a select circuit, and outputted by not less than two lengths of signal metal interconnects. Memory cells of a built-in memory are disposed in staggered arrangement. Respective pixels of a display section include a pixel switch and a capacitor, and a gate of the pixel switch is connected to a vertical scanning circuit via a gate line.

5 Claims, 14 Drawing Sheets

IMAGE DISPLAY APPARATUS

CLAIM OF PRIORITY

The present application claims priority from Japanese application JP 2005-040016 filed on Feb. 17, 2005, the content of which is hereby incorporated by reference into this application.

FIELD OF THE INVENTION

The invention relates to an image display apparatus with a portion of a display substrate area, around a display section, being small, low in power consumption, and capable of effecting high-definition image display.

BACKGROUND OF THE INVENTION

A conventional technology is described hereinafter with reference to FIG. 12.

To start with, a structure according to a first example of the conventional technology is described. FIG. 12 is a circuit configuration diagram of a liquid crystal display using the conventional technology. Respective pixels of a display section 216 include a pixel switch 211 and a liquid crystal capacitor 212, and an opposite electrode of the liquid crystal capacitor 212 is connected to a common power supply line 217. The gate of the pixel switch 211 is connected to a vertical scanning circuit 215 via a gate line 214, and one end of the pixel switch 211 is connected to a DA conversion circuit 209 via a signal line 213.

An output of a latch circuit 208 is delivered to the digital/analogue (DA) conversion circuit 209 and an output of a sense amplifier 207 is delivered to the latch circuit 208. A signal from one end of a data line 203 is delivered to the sense amplifier 207. The data lines 203 are provided with the memory cells 221, respectively, the memory cells 221 being arranged in matrix fashion. As with memory cells of a DRAM (Dynamic Random Access Memory), the memory cells 221 each include one transistor switch and one capacitor (hereinafter referred to as "a 1T 1C configuration"), that is, a memory switch 201 and a memory capacitor 202, and the gate of the memory switch 201 is connected to a memory select circuit 205 via a memory gate line 204. The other end of the data line 203 is connected to a data input circuit 206.

Next, an operation of the first example of the conventional technology is described.

As a result of the memory select circuit 205 turning ON the memory switches 201 in a predetermined row via the memory gate line 204, memory data is read, and a signal thereof is amplified by the sense amplifier 207 to be subsequently written into the latch circuit 208. At this point in time, the memory select circuit 205 repeatedly reads the memory cells 221 corresponding to n-rows, thereby enabling the latch circuit 208 to read image data of n-bits.

The image data of n-bits as read is outputted from the latch circuit 208 to the DA conversion circuit 209, which converts the image data of n-bits into one analogue signal voltage to be then outputted to the signal line 213. At this point in time, the vertical scanning circuit 215 turns ON the pixel switch 211 at a predetermined address via the gate line 214, whereupon the analogue signal voltage is written into the liquid crystal capacitor 212 of the pixel as selected, thereby optically effecting image display.

In this connection, because the signal amplified by the sense amplifier 207 is written into the data line 203 as well, refresh operations of the memory cells are concurrently executed at this point in time.

With the conventional technology, image display can be effected without new input of image data from outside, so that low power consumption display can be effected with a peripheral drive circuit kept in a sleep condition.

Such an example of the conventional technology as described, is disclosed in detail in, for example, JP-A No. 085065/1999.

Further, with the example of the conventional technology, a memory cell layout is described again with reference to FIG. 13. FIG. 13 is a layout plan of the memory cells according to the first example.

One analogue image signal is stored by use of the memory cells 221 for n pieces (six pieces in FIG. 13), disposed in the column direction along each of the data lines 203. Accordingly, at the time of outputting data on one analogue image signal, corresponding to one word, it is necessary to output n pieces of data by scanning n lengths of the memory gate lines 204.

The memory cell layout according to the example of the conventional technology is disclosed in, for example, JP-A No. 085065/1999, and so forth, as described in the foregoing.

Meanwhile, another memory cell layout according to a second example of the conventional technology is described with reference to FIG. 14.

FIG. 14 is a layout plan of memory cells according to the second example of the conventional technology.

It represent the case where one analogue image signal is stored by use of the memory cells 221 for n pieces (six pieces in FIG. 14), disposed in the row direction along each of the memory gate lines 204. Accordingly, at the time of outputting data on one analogue image signal, corresponding to one word, it is necessary to obtain n pieces of data outputted to n lengths of the data lines 203.

The memory cell layout according to the example of the conventional technology, as described above, is disclosed in detail in, for example, JP-A No. 082656/2002, and so forth.

SUMMARY OF THE INVENTION

With the liquid crystal displays according to the examples of the conventional technology, problems have remained in respect of a memory cell layout although those liquid crystal displays are capable of effecting display at low power consumption.

A configuration of the first example of the conventional technology, shown in FIG. 13, has a problem in that as a result of an increase in the number of bits for the image data, it has been impossible to reduce a portion of a display substrate area, around a display section. This is because the number of the memory cells in the direction of the data line comes to increase along with the increase in the number of bits for the image data, thereby resulting in an increase in circuit width of a memory section.

Further, a configuration of the second example of the conventional technology, shown in FIG. 14, has a problem in that as a result of an increase in the number of bits for the image data, it becomes difficult to implement higher definition for the pixels. This is because the number of the memory cells to be disposed in a width for the pixels comes to increase along with the increase in the number of bits for the image data, so that it becomes difficult to reduce the width for the pixels less than a given size.

It is therefore an object of the invention to provide an image display apparatus with a portion of a display substrate area, around a display section, being small, low in power consumption, and capable of effecting high-definition image display.

An example of representative means of the invention, disclosed in the present specification, is shown as follows.

That is, the invention provides an image display apparatus including a display section where plural pixels are arrayed, an analogue image signal generation means for generating an analogue image signal to be inputted to the pixels on the basis of a digital image signal, and an image signal storage means for storing the digital image signal, the constituents being provided over one and the same insulating substrate, wherein the image signal storage means includes a memory cell array with memory cells disposed in matrix fashion, the memory cells being selected by respective select metal interconnects disposed in a row direction, and the digital image signal is inputted/outputted by respective signal metal interconnects disposed in a column direction while the analogue image signal generation means generates one unit of the analogue image signal on the basis of the digital image signal selected by not less than two lengths of the select metal interconnects, and outputted by not less than two lengths of the signal metal interconnects.

With the invention, because a memory and the display section are provided over one and the same substrate, it is possible to provide the image display apparatus with the portion of the display substrate area, around the display section, being small, low in power consumption, and capable of effecting high-definition image display.

DETAILED DESCRIPTION OF THE PREFERRED EMBODIMENTS

Embodiments of an image display apparatus according to the invention are described in detail hereinafter with reference to the accompanying drawings.

First Embodiment

A configuration and an operation of a first embodiment of an image display apparatus according to the invention are described in sequence hereinafter with reference to FIGS. 1 to 6.

Figure 1:
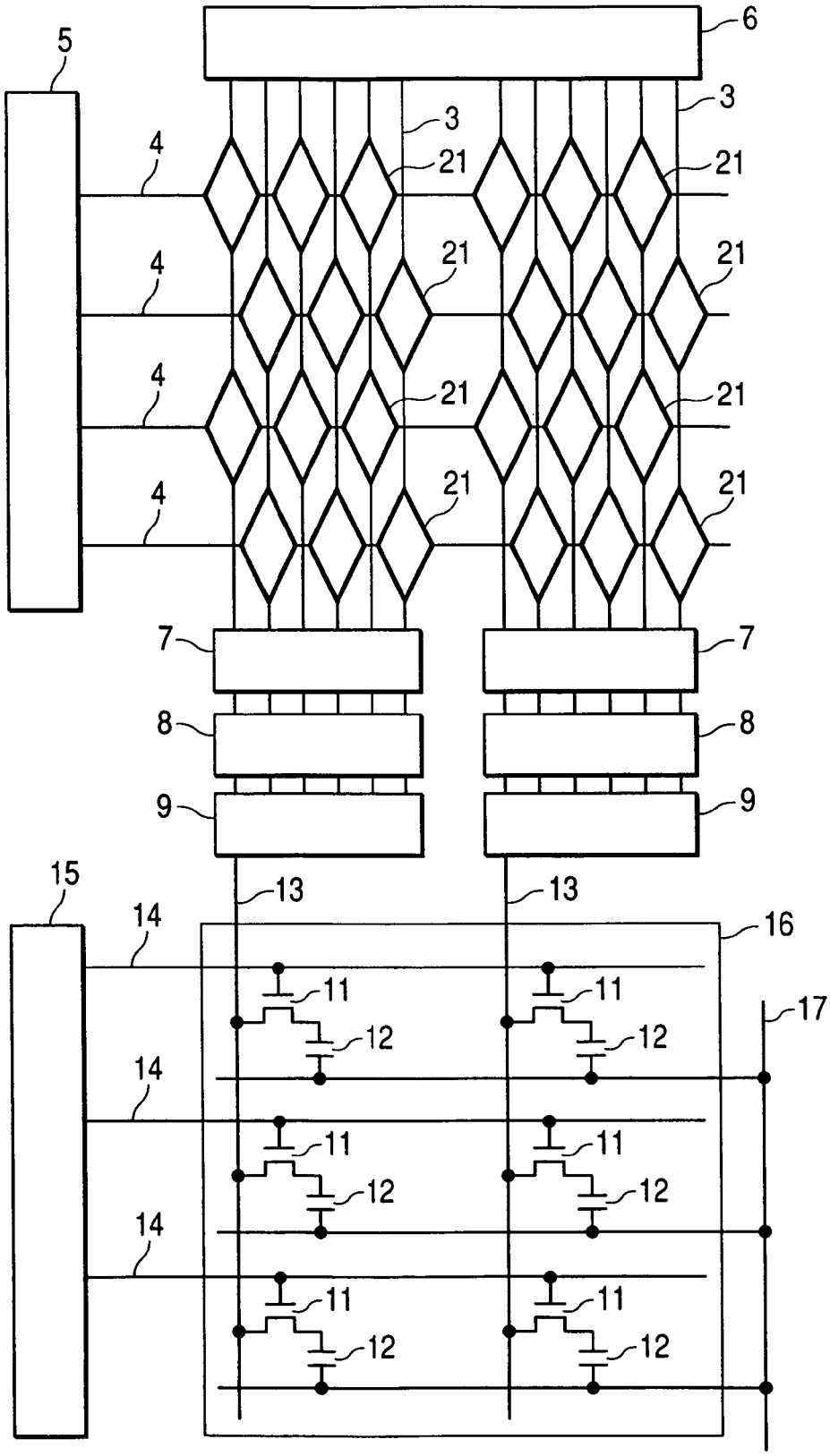
FIG. 1 is a circuit configuration diagram of a liquid crystal display according to a first embodiment of the invention.

FIG. 1 is a circuit configuration diagram of a liquid crystal display according to the first embodiment of the invention. Respective pixels of a display section 16 include a pixel switch 11 and a liquid crystal capacitor 12, and an opposite electrode of the liquid crystal capacitor 12 is connected to a common power supply line 17. The gate of the pixel switch 11 is connected to a vertical scanning circuit 15 via a gate line 14, and one end of the pixel switch 11 is connected to a DA conversion circuit 9 via a signal line.13.

An output of a latch circuit 8 is delivered to the DA conversion circuit 9, an output of a sense amplifier 7 is delivered to the latch circuit 8, and a signal from one end of a data line 3 is delivered to the sense amplifier 7. The data lines 3 are provided with memory cells 21, respectively, the memory cells 21 being arranged in staggered fashion. The memory cell 21 also is connected to a memory select circuit 5 via a memory gate line 4. The other end of the data line 3 is connected to a data input circuit 6.

Further, a memory cell layout circuit according to the present embodiment is more specifically described hereinafter with reference to FIG. 2.

Figure 2:
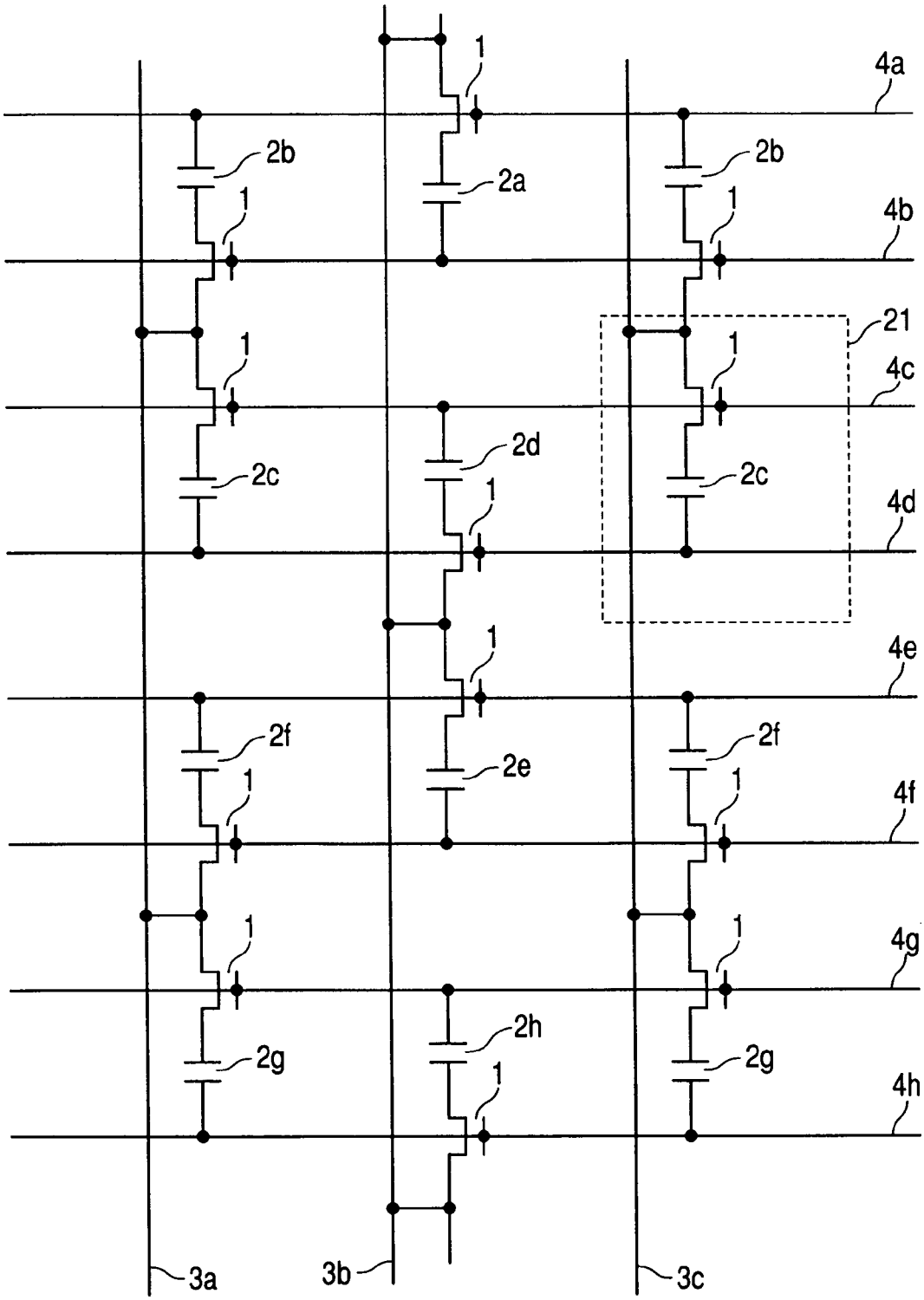
FIG. 2 is a memory cell layout base circuit diagram the according to the first embodiment.

FIG. 2 is a memory cell layout base circuit diagram the according to the present embodiment.

As with the memory cells of the DRAM of the 1T1C configuration, the memory cells 21 each include a memory switch (transistor) 1 and a memory capacitor 2, the gate of a memory switch 1 is connected to the memory gate line 4, and one end of the memory switch 1 is connected to the data line 3. Further, one end of the memory capacitor 2 is connected to the memory gate line 4 for the memory cell adjacent thereto. Now, as shown in FIG. 2, the memory cells in odd columns, corresponding to the data lines 3*a*, 3*c*, respectively, and the memory cell in even column, corresponding to the data line 3*b*, are disposed so as to be staggered against each other. Further, the memory cells are disposed so as to be vertically symmetrical in the direction of the data line 3 with respect to a contact between the respective memory cells, and the data line 3. Further, in FIG. 2, the English alphabet letters, such as 4*a*, 4*b*, 4*c*, 4*d*, 4*e*, 4*f*, 4*g*, and 4*h*, are suffixed to the respective memory gate lines 4, and the English alphabet letters, such as 3*a*, 3*b*, and 3*c*, are suffixed to the respective data lines 3. This is for the purpose of explanation to be described later on with reference to FIG. 4.

Next, respective configurations of the sense amplifier 7, and the latch circuit 8, according to the present embodiment, are more specifically described with reference to FIG. 3.

Figure 3:
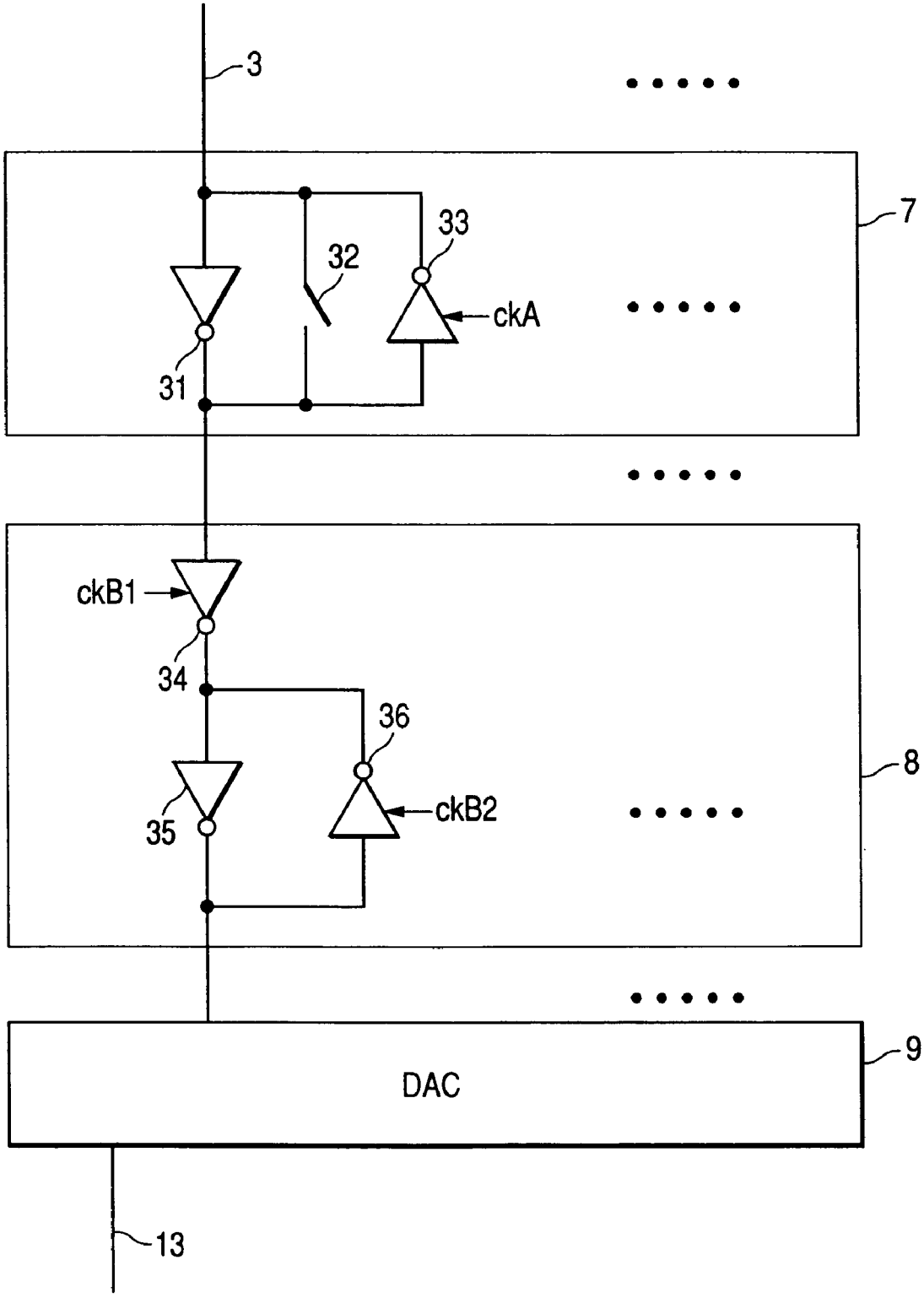
FIG. 3 is a circuit configuration diagram showing a sense amplifier circuit and a latch circuit, according to the first embodiment.

FIG. 3 is a circuit configuration diagram showing respective internal basic circuits of the sense amplifier 7, and the latch circuit 8, according to the present embodiment. The internal basic circuit of the sense amplifier 7 includes an inverter 31, a short-circuiting switch 32 for short-circuiting input/output of the inverter 31, and a feedback clocked inverter 33 to be controlled by a clock ckA, for feed backing the output of the inverter 31, and the internal basic circuit of the sense amplifier 7 corresponds to one pixel of six bits, six pieces of the internal basic circuits being provided for each of the sense amplifiers 7.

The internal basic circuit of the latch circuit 8 includes a clocked inverter 34 to be controlled by a clock ckB1 for executing latch sampling, an inverter 35 for temporarily storing data as sampled, and a feedback clocked inverter 36 to be controlled by a clock ckB2, and the internal basic circuit of the latch circuit 8 also corresponds to one pixel of six bits, six pieces of the internal basic circuits being provided for each of the latch circuits 8. Further, an output of the latch circuit 8 is delivered to the DA conversion circuit (DAC) 9, but the DA conversion circuit 9 adopted in this case has a common circuit configuration, and DA conversion circuits of various configurations have thus far been reported, omitting therefore a description thereof.

Next, an operation of the present embodiment is described hereinafter.

A basic operation of the present embodiment is similar to that of the example of the conventional technology as previously described. That is, as a result of the memory select circuit 5 turning ON the memory switches 1 in a predetermined row via the memory gate line 4, memory data is read, and a signal thereof is amplified by the sense amplifier 7 to be subsequently written into the latch circuit 8. Image data of six bits, as read, is outputted from the latch circuit 8 to the DA conversion circuit 9, and the DA conversion circuit 9 converts the image data of six bits into one analogue signal voltage to be then outputted to the signal line 13. At this point in time, the vertical scanning circuit 15 turns ON the pixel switch 11 at a predetermined address via the gate line 14, whereupon the analogue signal voltage is written into the liquid crystal capacitor 12 of the pixel as selected, thereby optically effecting image display. Further, because the signal amplified by the sense amplifier 7 is written into the data line 3 as well, refresh operations of the respective memory cells are concurrently executed at this point in time.

With the present embodiment, however, for read-out of the image data of six bits, two lengths of the memory gate lines 4 are concurrently driven, and respective outputs of six lengths of the data lines 3 are concurrently fetched.

Next, the operation of the present embodiment is more specifically described with reference to FIG. 4.

Figure 4:
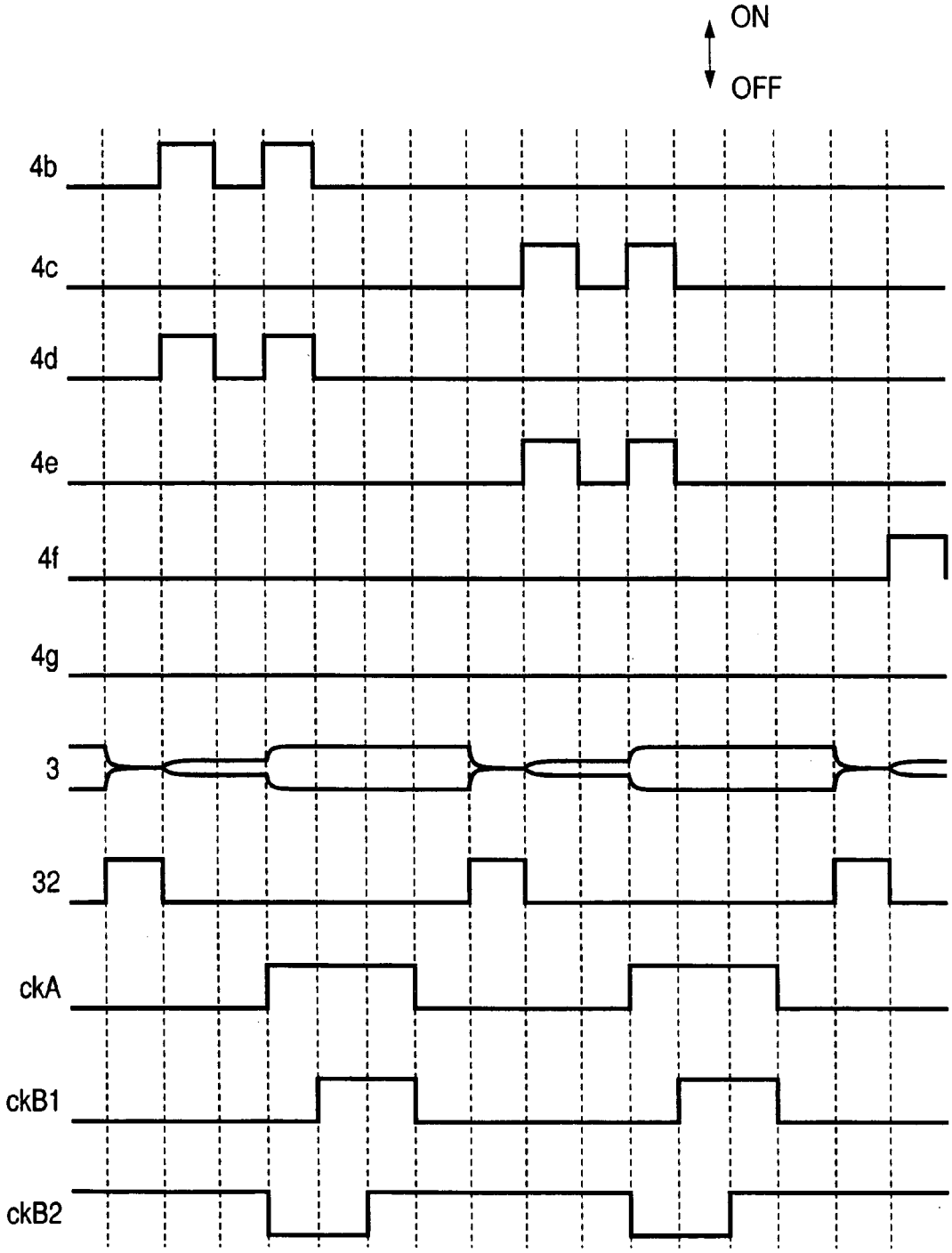
FIG. 4 is a timing chart showing an operation of memory cells according to the first embodiment.

FIG. 4 is a timing chart showing an operation of the memory cells 21 according to the present embodiment. As indicated by the arrows at respective ends of a shaft, shown in the figure, the upper side in the figure indicates that the respective switches or gates are in the on-condition while the lower side in the figure indicates that the respective switches or gates are in the off-condition.

It will be described hereinafter that the data is read from the memory capacitors 2*b*, 2*d* by scanning the memory gate lines 4*b*, 4*d*, respectively.

First, when the short-circuiting switches 32 of the respective sense amplifiers 7 are turned ON, the input/output of the inverter 31 as short-circuited, will be at an intermediate voltage between high (HI) and low (LOW), thereby resetting the data lines 3 to an intermediate voltage.

Subsequently, if the memory gate lines 4*b*, 4*d* are concurrently turned ON/OFF after the short-circuiting switches 32 are turned OFF, the data is read from the memory capacitors 2*b*, 2*d* to the respective data lines 3 to thereby modulate potentials of the respective data lines 3. At this point in time, the outputs of the respective inverters 31 are turned ON/OFF according to the data read by the respective data lines 3, results of which are fed back to the respective data lines 3 due to the feedback clocked inverter 33 being turned ON by the agency of the clock ckA.

Further, if the memory gate lines 4*b*, 4*d* are concurrently turned ON/OFF at this point in time, the memory data fed back to the respective data lines 3 is again written into the memory capacitors 2*b*, 2*d*, thereby implementing a refresh operation as with the case of the DRAM. Meanwhile, at this point in time, by turning OFF the feedback clocked inverter 36 by the agency of the clock ckB2, and subsequently, by turning ON the clocked inverter 34 to be controlled by the agency of the clock ckB1, it is possible to fetch the output of the inverter 31 into the inverter 35 inside the latch circuit 8.

Thereafter, after the feedback clocked inverter 36 is turned ON by the agency of the clock ckB2, the clocked inverter 34 to be controlled by the clock ckB1 is turned OFF to thereby complete this latch operation, and by concurrently turning OFF the feedback clocked inverter 33 by the agency of the clock ckA, preparation for reading the following memory data is executed.

The above operation completes read-out of the memory data corresponding to one pixel row from the memory capacitors 2*b*, 2*d* by scanning the memory gate lines 4*b*, 4*d*, respectively, followed by starting read-out of memory data corresponding to a succeeding pixel row from the memory capacitors 2*c*, 2*e* by scanning the memory gate lines 4*c*, 4*e*, respectively.

Thereafter, that image data as read is converted into analogue signal voltages by the DA conversion circuit 9 to be then written into the respective pixels, thereby effecting optical display. Such an operation, however, is a generally well-known operation as with the example of the conventional technology, omitting therefore a description thereof.

In this case, the memory gate lines 4*b*, 4*d* are turned ON/OFF twice, which is for the purpose of avoiding the effect of feed-through of the memory switches 1 at the time of the inverter 31 sensing a read-out signal by temporarily turning OFF the memory switches 1 as selected. Accordingly, if the effect of the feed-through of the memory switches 1 is sufficiently small, the memory gate lines 4*b*, 4*d* can be turned ON/OFF once altogether without turning OFF the memory gate lines 4*b*, 4*d* at the time of sensing.

Figure 14:
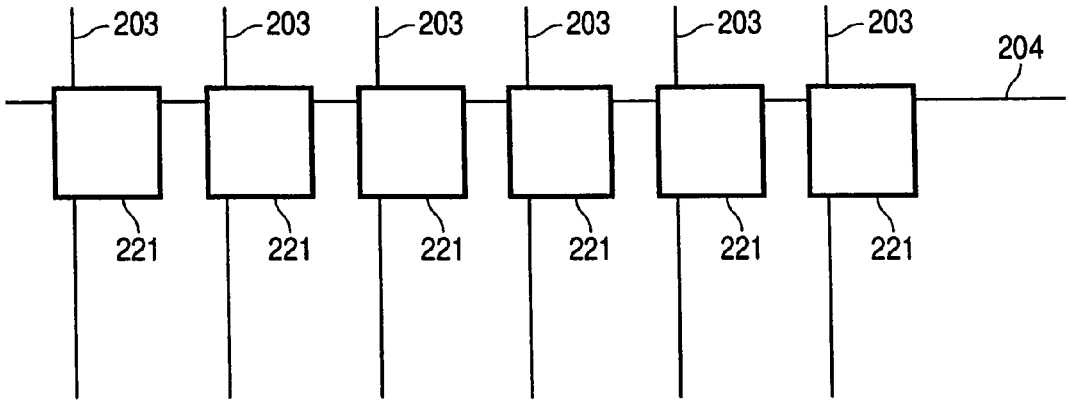
PRIOR ART FIG. 14
FIG. 14 is a layout plan of memory cells according to a second example of the conventional technology.

With the present embodiment, for read-out of the image data of six bits, two lengths of the memory gate lines 4 are concurrently driven, and respective outputs of six lengths of the data lines 3 are concurrently fetched. Thus, by concurrently driving two lengths of the memory gate lines 4, the memory cells can be disposed on a layout of higher density as compared with that for the example of the conventional technology, shown in FIG. 14.

The above operation is further described hereinafter with reference to FIG. 5.

Figure 5:
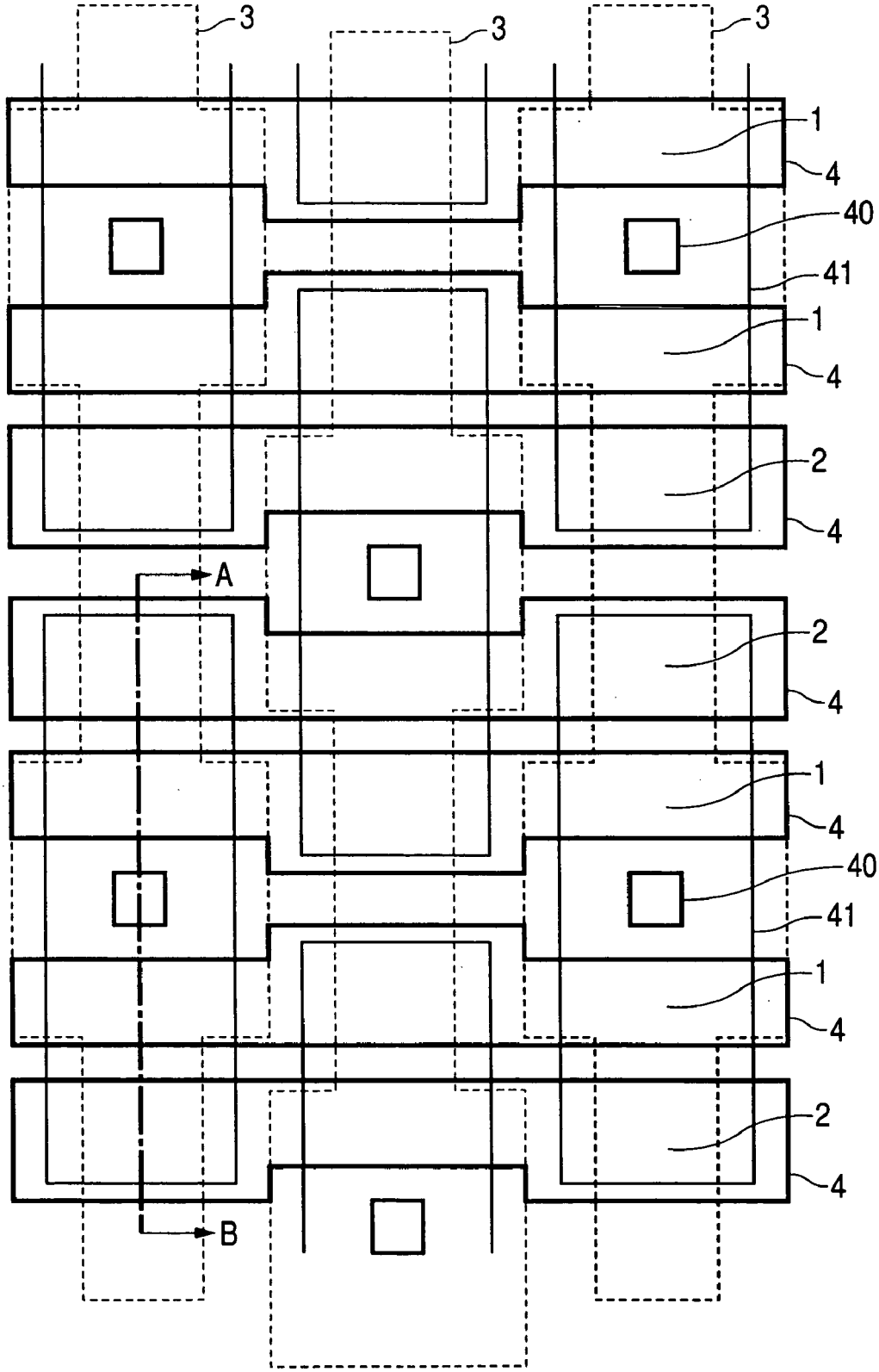
FIG. 5 is a layout view of a memory cell section according to the first embodiment.

FIG. 5 is a plan view showing a layout of a memory cell section. In FIG. 5, a broken line indicates the data line 3 of a metal interconnect, a thick line indicates the memory gate line 4, a thin line indicates a channel layer 41 formed of polycrystalline-Si, and a square delineated by a thick line indicates a contact hole 40 between the data line 3 and the channel layer 41 of polycrystalline-Si. As is evident from the figure, in order that mating allowance from a yield point of view is secured around the contact hole 40, the data line 3 of the metal interconnect, indicated by the broken line, need be provided with dog-bones, however, with the present embodiment, since the respective memory cells in even columns are disposed in staggered fashion against the respective memory cells in odd columns, the dog-bone can be sufficiently laid out while securing the allowance between the data lines 3 adjacent to each other.

Figure 6:
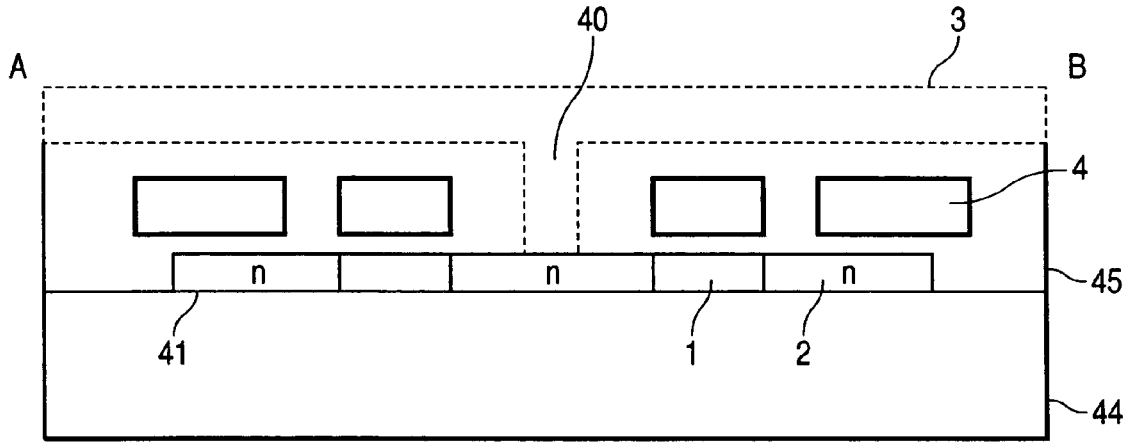
FIG. 6 is a sectional view showing a structure of a portion of the memory cell section, taken on line A-B, shown in FIG. 5.

FIG. 6 is a sectional view showing a structure of a portion of the memory cell section, taken on line A-B, shown in FIG. 5. Over the same glass substrate 44 where the pixels for the liquid crystal display, the DA conversion circuits 9, and so forth are disposed, there are provided the memory switches 1 each made up of a TFT (Thin Film Transistor), and the memory capacitors 2, using the memory gate lines 4, and the channel layer 41 formed of polycrystalline-Si, as with the pixels for the liquid crystal display, the DA conversion circuits 9, and so forth, and further, there are formed an interlayer dielectric 45, and the data line 3 formed of the metal interconnect. Those devices are implemented by adoption of an n-channel type MOS (Metal Oxide Semiconductor) structure.

With the structure described as above, a variation thereto is possible wherein the channel layers 41 of polycrystalline-Si, adjacent to each other, are connected together in the column direction in an attempt for higher density, or a light-leak current is reduced by providing a light blocking layer underneath the memory cells, and so on.

Further, with the present embodiment, the TFT inside the respective memory cells is the nMOS transistor formed of polycrystalline-Si, however, if polarities of respective control voltages are reversed, a pMOS transistor can be used as appropriate, and the constituent material of the transistor is not limited to polycrystalline-Si, so that other organic/inorganic semiconductor thin-films can be used for the transistor.

Second Embodiment

A second embodiment of an image display apparatus according to the invention is described hereinafter with reference to FIGS. 7 and 8.

A liquid crystal display according to the present embodiment is basically similar in configuration and operation to the first embodiment. The present embodiment, however, differs from the first embodiment in respect of its configuration around a sense amplifier 53, and operation timing of memory cells, and those points are therefore described hereinafter.

Figure 7:
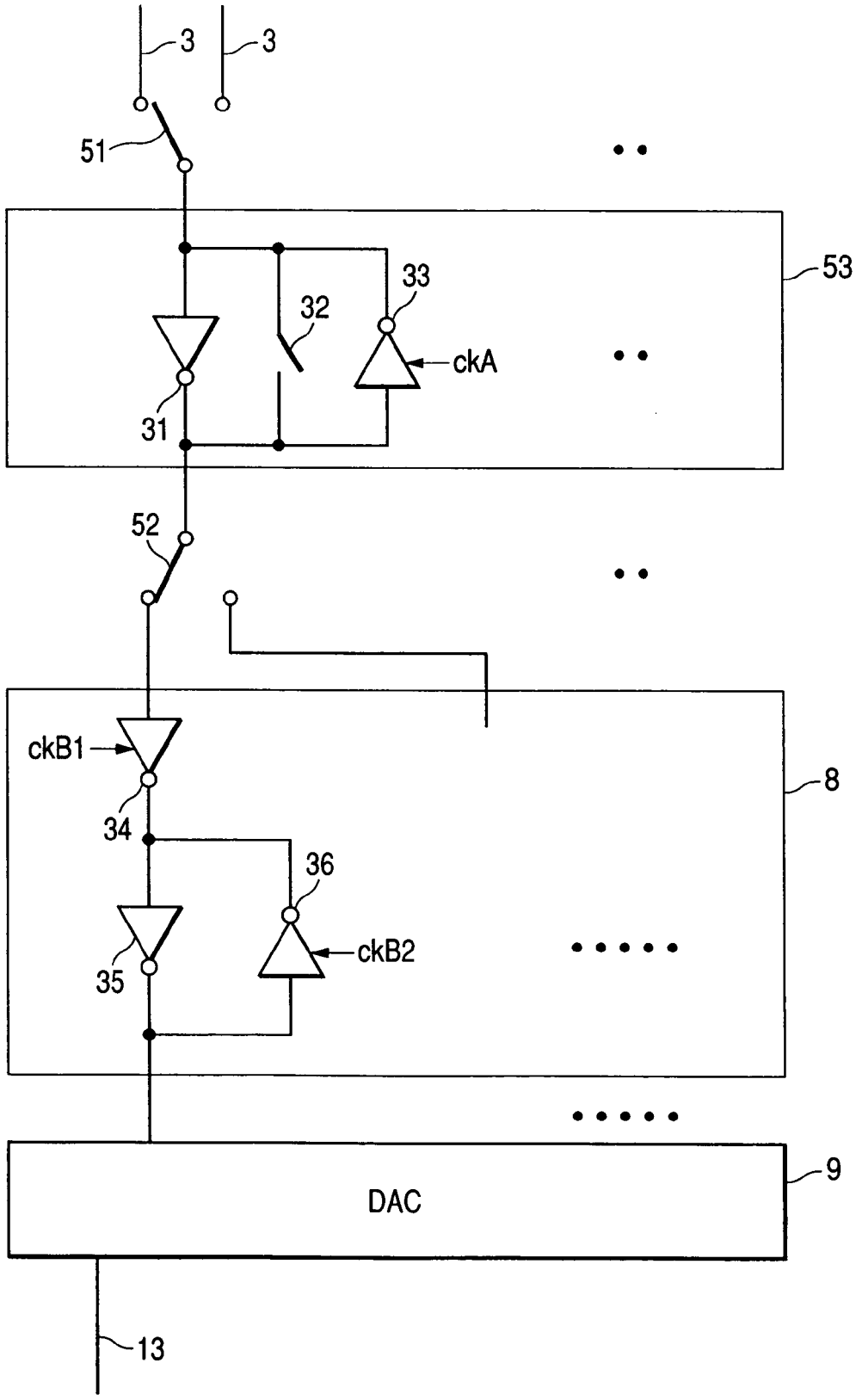
FIG. 7 is a circuit configuration diagram showing a sense amplifier circuit and a latch circuit, according to a second embodiment.

FIG. 7 is a circuit configuration diagram showing respective internal basic circuits of the sense amplifier 53, and a latch circuit 8, according to the present embodiment. The internal basic circuit of the sense amplifier 53 includes an inverter 31, a short-circuiting switch 32 for short-circuiting input/output of the inverter 31, and a feedback clocked inverter 33 to be controlled by a clock ckA, for feeding back the output of the inverter 31, and the internal basic circuit of the sense amplifier 53 corresponds to one pixel of six bits, three pieces of the internal basic circuits being provided for each of the sense amplifiers 53. Further, an input terminal and an output terminal of the internal basic circuit of the sense amplifier 53 are provided with an input changeover switch 51, and an output changeover switch 52, respectively.

The internal basic circuit of the latch circuit 8 includes a clocked inverter 34 to be controlled by a clock ckB1, for executing latch sampling, an inverter 35 for temporarily storing data as sampled, and a feedback clocked inverter 36 to be controlled by a clock ckB2, and the internal basic circuit of the latch circuit 8 also corresponds to one pixel of six bits, six pieces of the internal basic circuits being provided for each of the latch circuits 8. The latch circuit 8 is similar in configuration to that for the first embodiment.

Next, an operation of the present embodiment is described hereinafter.

A basic operation of the present embodiment is similar to that of the first embodiment as previously described, omitting therefore a description thereof. With the present embodiment, however, for read-out of image data of six bits, two lengths of memory gate lines 4 are sequentially driven, and respective outputs of six lengths of data lines 3 are fetched in two steps.

The above operation is more specifically described with reference to FIG. 8.

Figure 8:
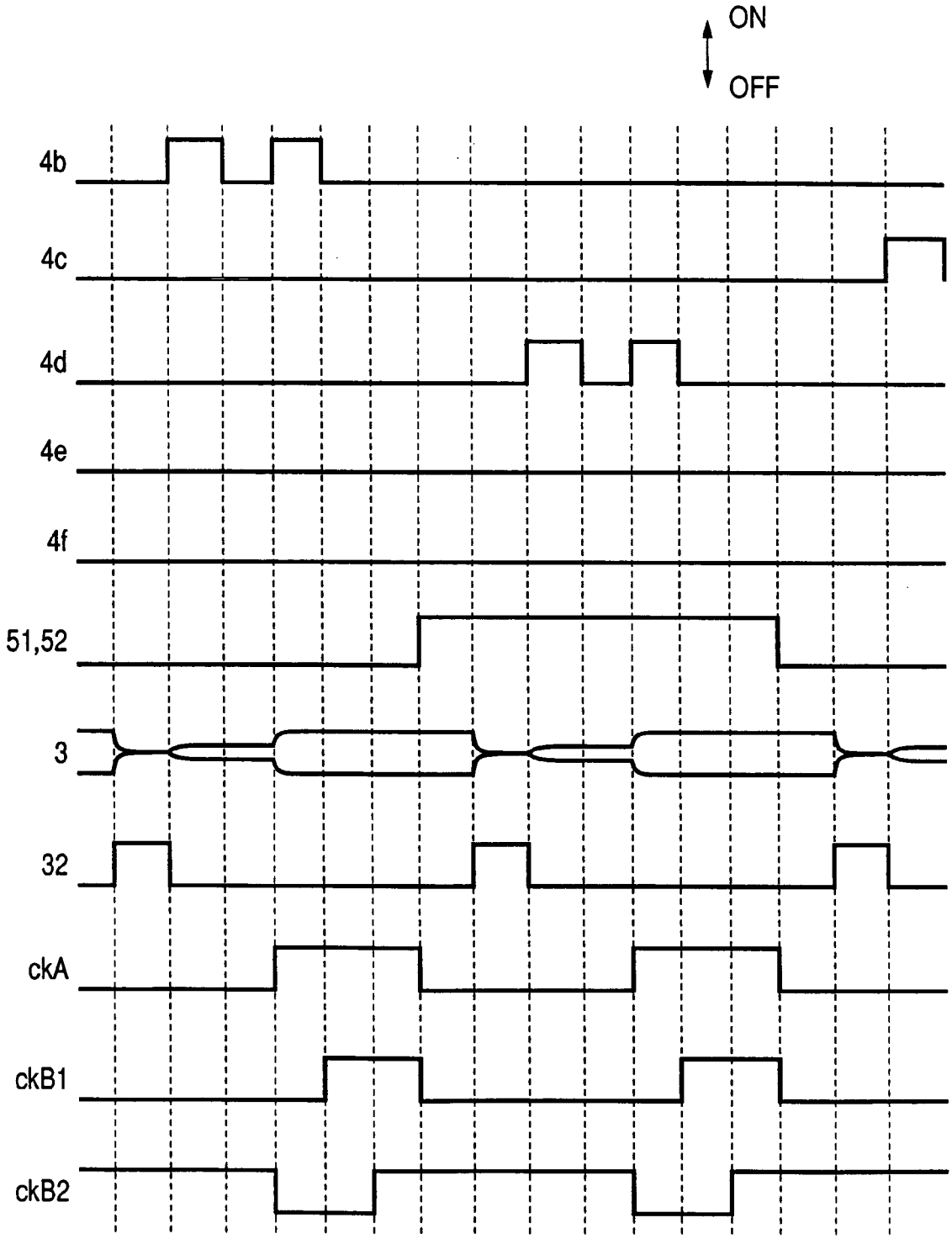
FIG. 8 is a timing chart showing an operation of memory cells according to the second embodiment.

FIG. 8 is a timing chart showing the operation of memory cells 21 according to the present embodiment. As indicated by the arrows at respective ends of a shaft, shown in the figure, the upper side in the figure indicates that respective switches or gates are in the on-condition while the lower side in the figure indicates that the respective switches or gates are in the off-condition.

It will be described hereinafter that data is read out from the memory capacitors 2*b* by scanning the memory gate line 4*b*.

First, when the short-circuiting switches 32 of the respective sense amplifiers 53 are turned ON, the input/output of the inverter 31, as short-circuited, will be at an intermediate voltage between HI and LOW, thereby resetting the data lines 3 to the intermediate voltage.

Subsequently, if the memory gate line 4*b* is turned ON/OFF after the short-circuiting switches 32 are turned OFF, the data is read from the memory capacitors 2*b* to the respective data lines 3 to thereby modulate the potentials of the respective data lines 3. At this point in time, the outputs of the respective inverters 31 are turned ON/OFF according to the data read by the respective data lines 3, results of which are fed back to the respective data lines 3 due to the feedback clocked inverter 33 being turned ON by the agency of the clock ckA.

If the memory gate line 4*b* is turned ON/OFF at this point in time, the memory data that is fed back to the respective data lines 3 is again written into the memory capacitors 2*b*, respectively, thereby implementing a refresh operation as with the case of the DRAM. Meanwhile, at this point in time, by turning OFF the feedback clocked inverter 36 by the agency of the clock ckB2, and subsequently, by turning ON the clocked inverter 34 to be controlled by the agency of the clock ckB1, it is possible to fetch the output of the inverter 31 into the inverter 35 inside the latch circuit 8.

Thereafter, after the feedback clocked inverter 36 is turned ON by the clock ckB2, the clocked inverter 34 to be controlled by the clock ckB1 is turned OFF to thereby complete this latch operation, and by concurrently turning OFF the feedback clocked inverter 33 by the clock ckA, preparation for reading succeeding memory data is executed.

The above operation completes read-out of the memory data corresponding to the first half three bits of one pixel from the memory capacitors 2*b* by scanning the memory gate line 4*b*, and subsequently, followed by starting read-out of memory data corresponding to the last half three bits of one pixel from the memory capacitors 2*d* by scanning the memory gate line 4*d*. Prior to the above, the input changeover switch 51, and output changeover switch 52, provided at the input and output terminals of the sense amplifier 53, respectively, are concurrently changed over.

Thereafter, the read-out of the memory data corresponding to the last half three bits of one pixel from the memory capacitors 2*d* is similarly completed, thereby completing read-out of the memory data corresponding to one pixel row.

Subsequently, as for memory data corresponding to a succeeding pixel row, the first half thereof is similarly read out from the memory capacitors 2*c*, and the last half thereof is similarly read out from the memory capacitors 2*e*. Then, read-out of memory data corresponding to a succeeding pixel row is repeated by reading out the first half of one pixel from the memory capacitors 2*f*, and reading out the last half thereof from the memory capacitors 2*h*.

With the present embodiment, a compact memory cell layout can be implemented as with the case of the first embodiment, however, since the present embodiment has an advantage in that the internal basic circuits of the sense amplifier 53, prone to become large in circuit structure, can be used by a time division multiplex technique whereby the input changeover switch 51 and the output changeover switch 52 are switched over, there is obtained an additional advantageous effect of implementing the sense amplifier 53 compact in size.

Third Embodiment

A third embodiment of an image display apparatus according to the invention is described hereinafter with reference to FIG. 9. A liquid crystal display according to the present embodiment is basically similar in configuration and operation to the first embodiment. The present embodiment, however, differs from the first embodiment in respect of a memory cell layout circuit of memory cells 61, which is therefore described hereinafter.

Figure 9:
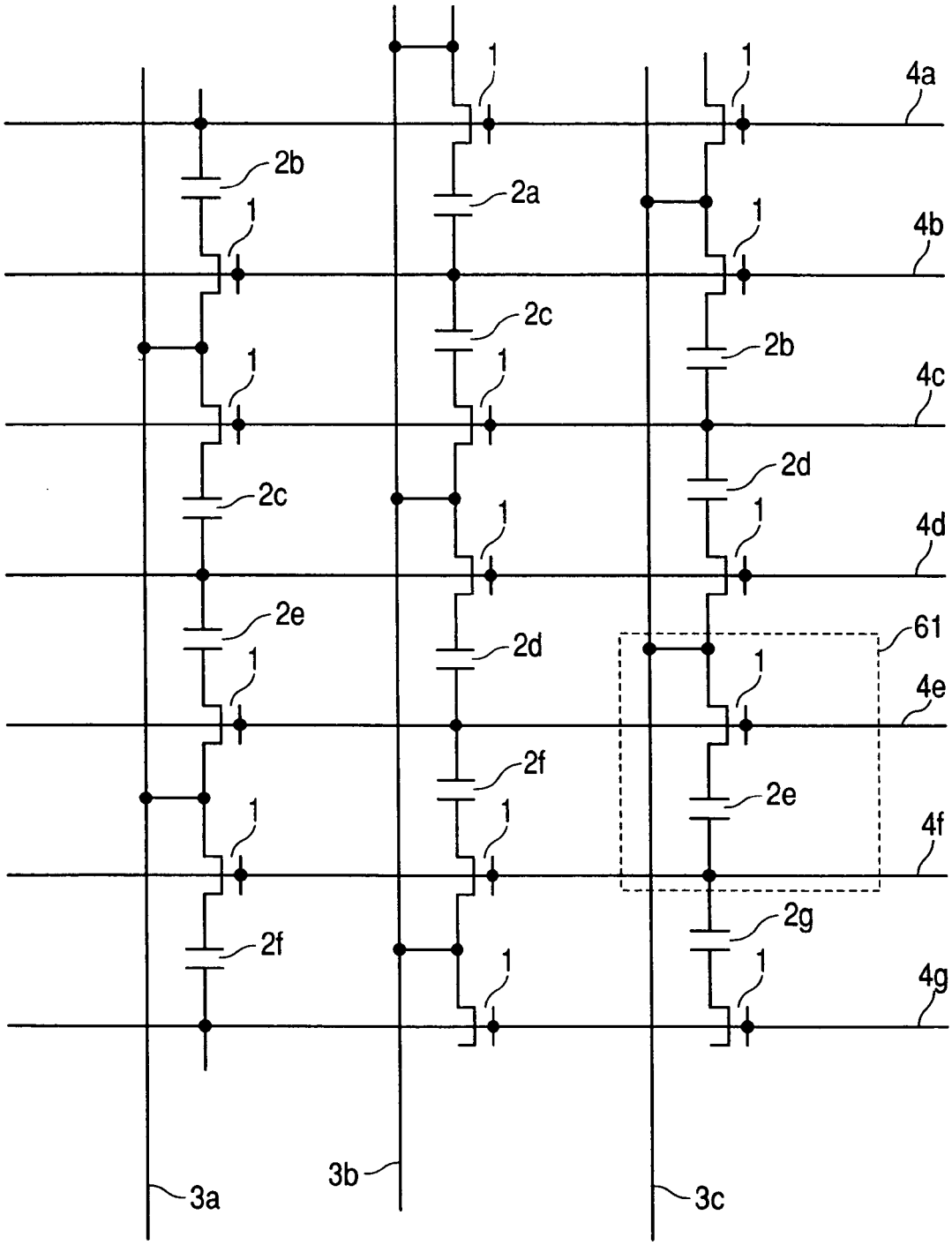
FIG. 9 is a memory cell layout base circuit diagram according to a third embodiment.

FIG. 9 is a memory cell layout base circuit diagram according to the present embodiment.

As with the memory cells of the DRAM of the 1T1C configuration, the memory cells 61 each include the memory switch 1 and the memory capacitor 2. The gate of the memory switch 1 is connected to the memory gate line 4, and one end of the memory switch 1 is connected to the data line 3. Further, one end of the memory capacitor 2 is connected to the memory gate line 4 for an adjacent memory cell. Now, as shown in FIG. 9, the memory cells in three columns, corresponding to the data lines 3*a*, 3*b*, 3*c*, respectively, are disposed so as to be staggered against each other. Further, the memory cells are disposed so as to be vertically symmetrical in the direction of the data line 3 with respect to a contact between the respective memory cells, and the data line 3.

An operation of the present embodiment is similar to that of the first embodiment, omitting therefore a description thereof. Further, a timing chart showing operations of the memory cells 61 is also similar to the timing chart according to the first embodiment, described with reference to FIG. 4, omitting therefore a description thereof.

With the present embodiment, the memory capacitor 2 is provided above and below the memory gate lines 4, respectively, so that it is possible to attain higher density of the memory cells as compared with the case of the first embodiment.

Fourth Embodiment

A fourth embodiment of an image display apparatus according to the invention is described hereinafter with reference to FIG. 10.

An organic EL (electroluminescence) display according to the present embodiment is basically similar in configuration and operation to the first embodiment. However, the present embodiment differs from the first embodiment in respect of display pixel configuration in that display pixels are not the liquid crystal pixels but organic EL pixels, and this is described hereinafter.

Figure 10:
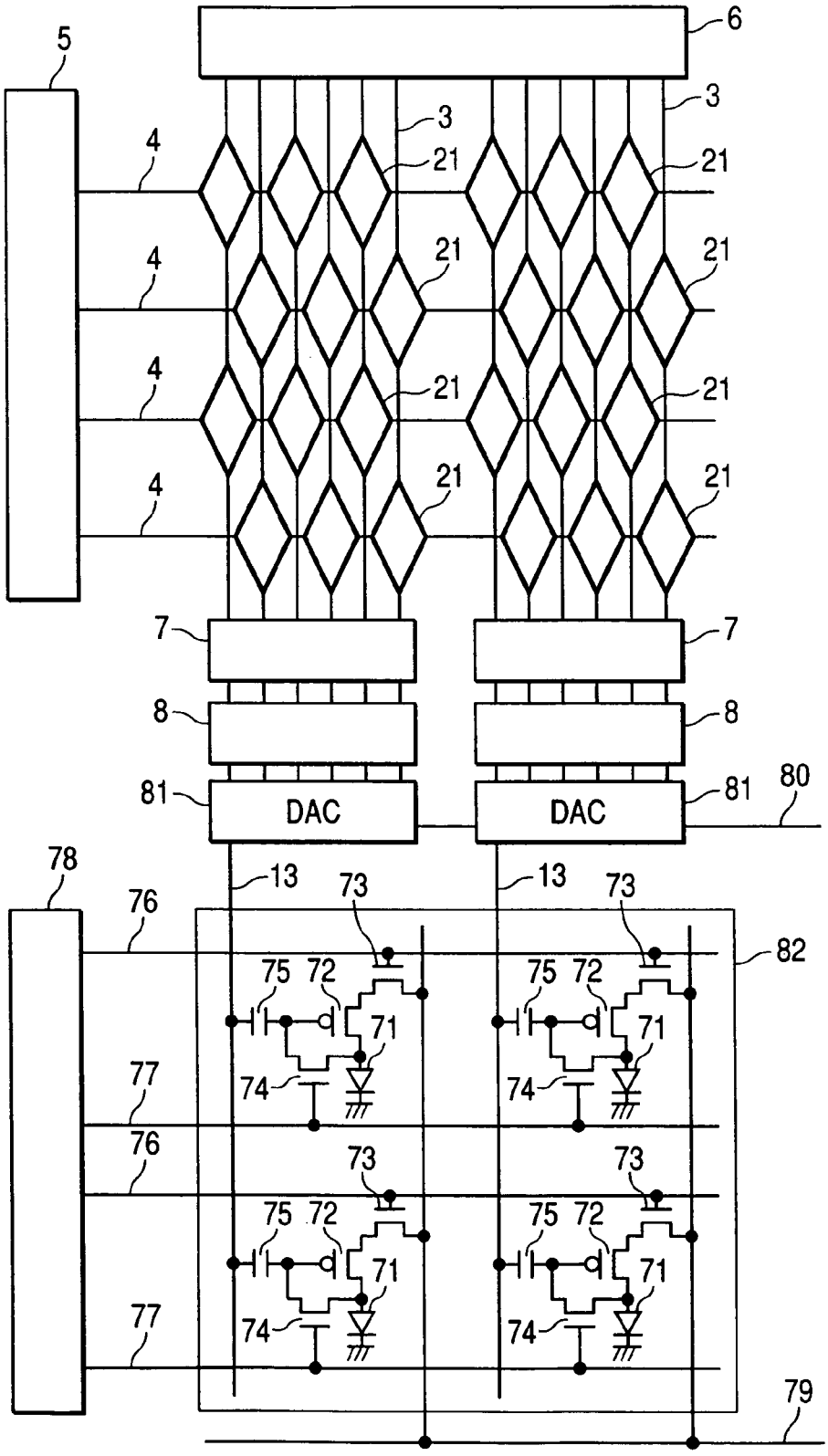
FIG. 10 is a circuit configuration diagram of an organic EL display according to a fourth embodiment.

FIG. 10 is a circuit configuration diagram of the organic EL display according to the present embodiment. Respective pixels of a display section 82 include an organic El device 71, an organic El drive transistor 72, a light-up control switch 73, a reset switch 74, and a memory capacitor 75, and an opposite electrode of the organic El device 71 is grounded. The light-up control switch 73 has one end connected to a power supply line 79. The gate of the reset switch 74 is connected to a vertical control circuit 78 via a reset line 77, and the gate of the light-up control switch 73 is connected to the vertical control circuit 78 via a light-up control line 76. The memory capacitor 75 has one end connected to a DA conversion circuit 81 via a signal line 13. The DA conversion circuit 81 is provided with a triangular-wave-voltage control terminal 80, and outputs a triangular-wave-voltage in place of an image signal voltage in accordance with an instruction from the triangular-wave-voltage control terminal 80.

An output of a latch circuit 8 is delivered to the DA conversion circuit 81, an output of a sense amplifier 7 is delivered to the latch circuit 8, and a signal from one end of each of data lines 3 is delivered to a sense amplifier 7. The data lines 3 are provided with memory cells 21, respectively, the memory cells 21 being disposed in staggered arrangement. The respective memory cells 21 are connected to the memory select circuit 5 via respective memory gate lines 4. Further, the other end of each of the data lines 3 is connected to a data input circuit 6. Thus, a circuit configuration of the present embodiment, preceding the latch circuit 8, is similar to that for the first embodiment.

Next, an operation of the present embodiment concerning outputting of the signal voltage from the memory cells 21 to the respective signal lines 13 is basically similar to that for the first embodiment, as previously described, omitting therefore a description thereof.

However, since the present embodiment differs in respect of the pixel configuration from the first embodiment, an operation in this respect is described hereinafter.

When an image signal voltage is outputted to the signal lines 13, a predetermined pixel row is selected by the vertical control circuit 78, whereupon the light-up control switch 73 and the reset switch 74 are turned ON via the light-up control line 76 and the reset line 77, respectively. At this point in time, input/output of an inverter circuit made up of the organic El drive transistor 72 and the organic El device 71 is held at an intermediate potential, and a difference between the intermediate potential and the image signal voltage is inputted to the memory capacitor 75. Thereafter, the light-up control switch 73 and the reset switch 74 are turned OFF, with the result that the difference between the intermediate potential and the image signal voltage is stored in the memory capacitor 75.

Thus, after completion of writing of the image signal voltage to all the pixels to be displayed, the DA conversion circuit 81 outputs the triangular-wave-voltage in place of the image signal voltage to the signal lines 13 in accordance with the instruction from the triangular-wave-voltage control terminal 80. At this point in time, the vertical control circuit 78 turns ON the light-up control switches 73 for all the pixels via the light-up control line 76. As a result, the respective pixels modulate a light-up period of the organic El device 71 depending on whether or not a prewritten image signal voltage is equivalent to the triangular-wave-voltage, thereby enabling optical image display to be executed.

The configuration and operation of the organic EL display described as above are disclosed in detail in JP-A No. 005709/2003, JP-A No. 122301/2003, and so forth.

Further, with the present embodiment, a light emitting device is not limited to the organic El device, and a common light emitting device, such as an inorganic El device, FED (Field-Emission Device), and so forth, can be obviously used as the light emitting device. With the present embodiment, a detailed description of a luminescence layer is omitted because the same does not represent the essence of the invention, however, various molecular structures such as a low-molecular type, polymer type and so forth can be adopted for an organic El device structure.

Further, with the present embodiment, the opposite electrode of the organic El device 71 is grounded, but the potential thereof need not necessarily be at 0V, and it goes without saying that the potential of the organic El device, including polarity thereof, may be altered as necessary.

Fifth Embodiment

A fifth embodiment of an image display apparatus according to the invention is described hereinafter with reference to FIG. 11.

Figure 11:
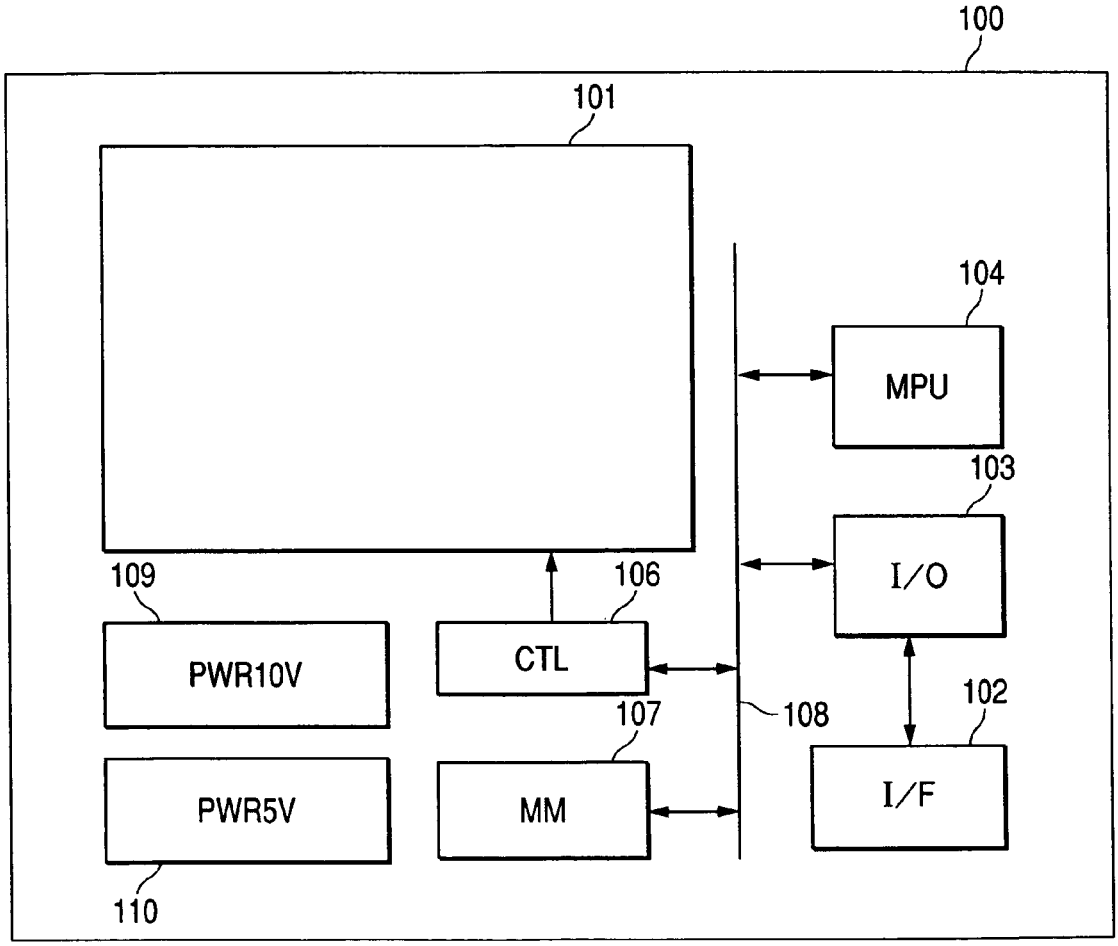
FIG. 11 is a block diagram of a TV image display apparatus according to a fifth embodiment.
Figure 12:
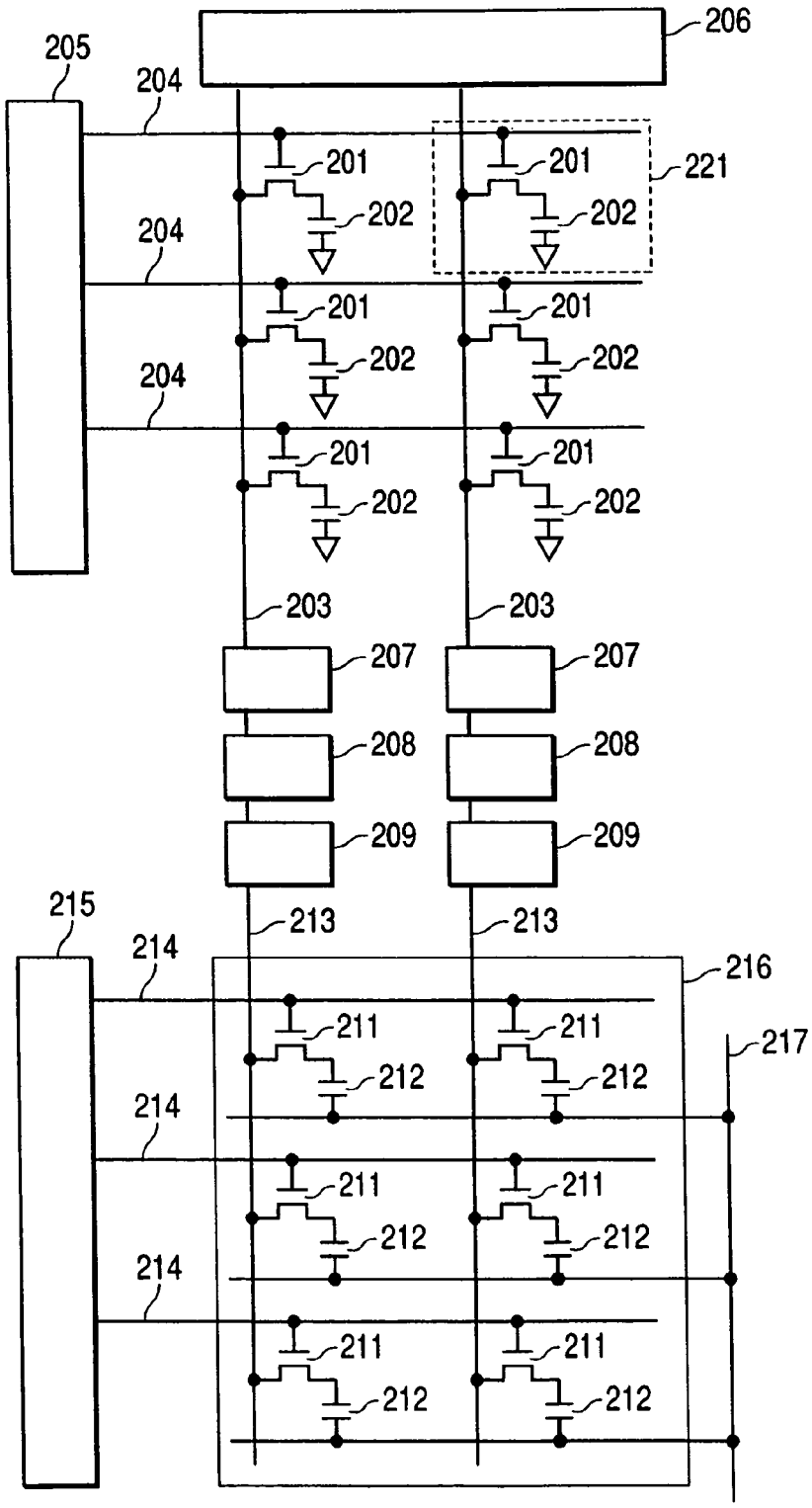
PRIOR ART FIG. 12
FIG. 12 is a circuit configuration diagram of a liquid crystal display using a conventional technology.
Figure 13:
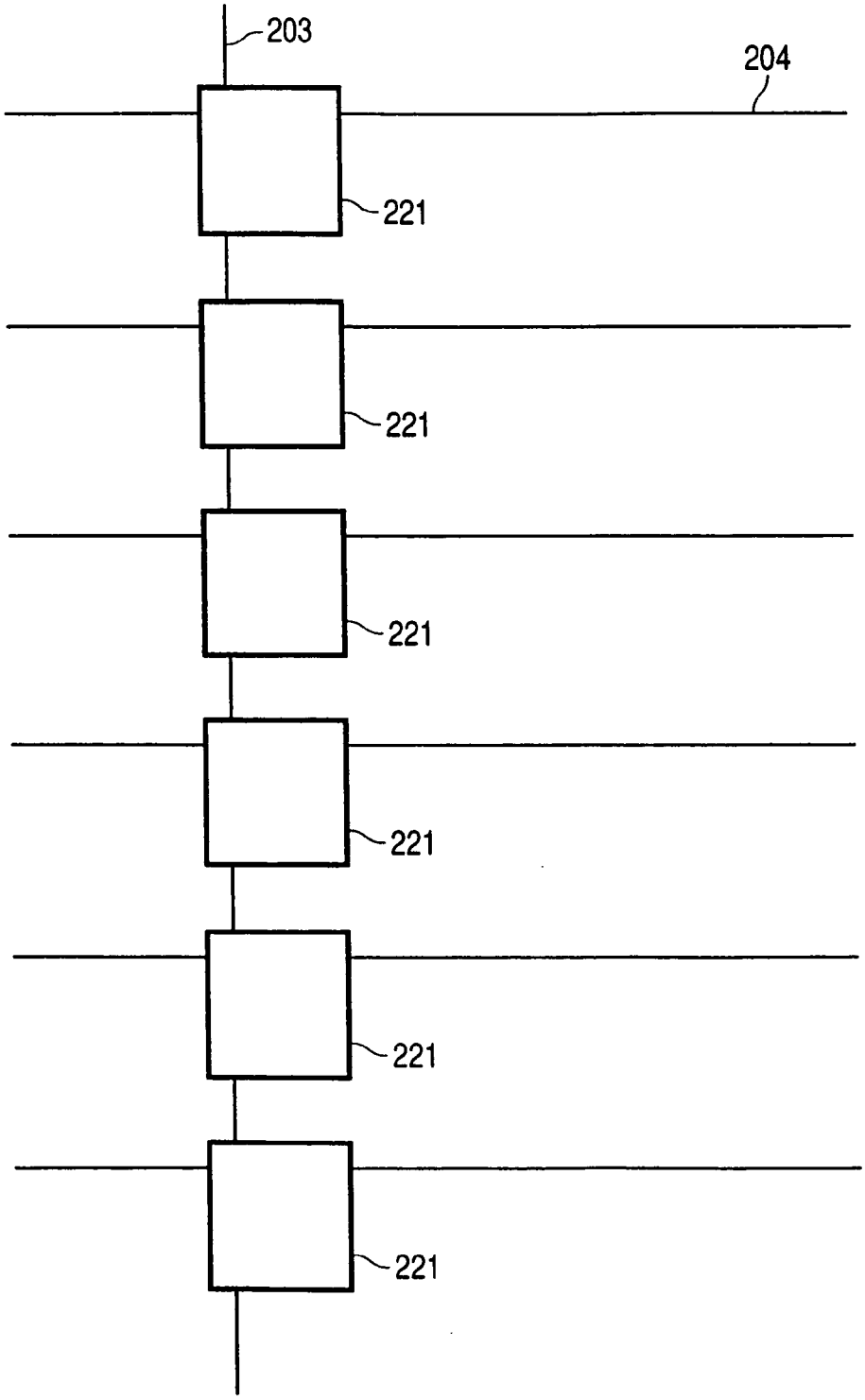
PRIOR ART FIG. 13
FIG. 13 is a layout plan of memory cells according to a first example of the conventional technology.

FIG. 11 is a block diagram of a TV image display apparatus 100 according to the present embodiment.

Compressed image data, and so forth are inputted as wireless data from outside to a wireless interface (I/F) circuit 102 for receiving ground wave digital signals and so forth, and an output of the wireless I/F circuit 102 is connected to a data bus 108 via an I/O (input/output) circuit 103. A microprocessor (MPU) 104, a display panel controller (CTL) 106, a frame memory (MM) 107, and so forth, besides the above-described, are connected to the data bus 108. Further, an output of the display panel controller 106 is inputted to a liquid crystal display panel 101. In addition, an out-of-panel 10V generation circuit (PWR 10V) 109 and an out-of-panel 5V generation circuit (PWR 5V) 110 are provided inside the TV image display apparatus 100. Now, the liquid crystal display panel 101 is basically identical in configuration and operation to the liquid crystal display panel according to the first embodiment previously described, omitting therefore a description of an internal configuration and operation thereof.

An operation of the present embodiment is described hereinafter. First, the wireless I/F circuit 102 fetches the compressed image data from outside according to an instruction, and transfers the image data to the microprocessor 104 and the frame memory 107 via the I/O circuit 103. Upon receiving an operation instruction from a user, the microprocessor 104 drives the TV image display apparatus 100 in whole as necessary to thereby execute decoding of the compressed image data, signal processing, and information display. At this point in time, the image data after the signal processing can be temporarily stored in the frame memory 107.

In the case where the microprocessor 104 issues a display instruction at this point in time, the image data is inputted from the frame memory 107 to the liquid crystal display panel 101 via the display panel controller (CTL) 106 in accordance with the instruction, whereupon the liquid crystal display panel 101 displays the image data as inputted in real time. At this point in time, the display panel controller (CTL) 106 outputs a predetermined timing pulse necessary for simultaneously displaying images while the out-of-panel 10V generation circuit (PWR 10V) 109 and the out-of-panel 5V generation circuit (PWR 5V) 110 each supply a predetermined power supply voltage to the liquid crystal display panel 101.

Further, even in the case where the image data is not inputted, the liquid crystal display panel 101 executes displaying of prewritten images by use of an image memory provided therein, as described with reference to the first embodiment. Further, the TV image display apparatus 100 incorporates a secondary battery provided separately for supplying power to drive the TV image display apparatus 100 in whole, which does not represent the essence of the invention, omitting therefore a description thereof.

With the present embodiment, it is possible to provide the TV image display apparatus 100 capable of effecting display at low power consumption, excellent in compactness, and design quality because of a small substrate area of the liquid crystal display panel, and further, capable of effecting high-definition display.

Further, with the present embodiment, for an image display device, use is made of the liquid crystal display described with reference to the first embodiment, however, needless to say, it is possible to use a display panel having a structure other than that without departing from the scope and spirit of the invention.

What is claimed is:

1. An image display apparatus comprising:

a first memory cell which comprises a first memory transistor and a first memory capacitor;

a second memory cell which comprises a second memory transistor and a second memory capacitor;

a first data line;

a second data line;

a first memory gate line;

a second memory gate line;

a memory select circuit to scan the first memory gate line and the second memory gate line;

a data input circuit to input data to the first and second data lines; and a sense amplifier to amplify data read out from the first and second capacitors through the first and second lines, wherein a gate of the first memory transistor is connected to the first memory gate line, a source-drain path of the first memory transistor is connected between the first data line and one end of the first memory capacitor, the other end of the first memory capacitor is connected to the second memory gate line, a gate of the second memory transistor is connected to the second memory gate line, a source-drain path of the second memory transistors is connected between the second data line and one end of the second memory capacitor, and the other end of the second memory capacitor is connected to the first memory gate line.

2. The image display apparatus according to claim 1, further comprising:

a DA conversion circuit;

wherein the DA conversion circuit converts digital image signals obtained by internally latching, in a lump, image signals outputted from the first and the second data lines into analogue signal voltages.

3. The image display apparatus according to claim 1, further comprising:

a DA conversion circuit;

wherein the DA conversion circuit converts digital image signals obtained by internally latching in sequence image signals outputted from the first and second data lines into analogue signal voltages as selected.

4. The image display apparatus according to claim 1, wherein the image display apparatus is a liquid crystal display device.

5. The image display apparatus according to claim 1, wherein the image display apparatus is an inorganic EL display device.

* * * * *